US006321413B1

(12) United States Patent
Zingg

(10) Patent No.: US 6,321,413 B1
(45) Date of Patent: Nov. 27, 2001

(54) RUNNING CARRIAGE FOR A SLIDING DOOR

(75) Inventor: Heinz Zingg, Niederuzwil (CH)

(73) Assignee: EKU AG, Sirnach (CH)

( * ) Notice: Subject to any disclaimer, the term of this patent is extended or adjusted under 35 U.S.C. 154(b) by 0 days.

(21) Appl. No.: 09/544,974

(22) Filed: Apr. 7, 2000

(30) Foreign Application Priority Data

Jun. 10, 1999 (CH) ..... 01083/99
Feb. 24, 2000 (CH) ..... 00359/00

(51) Int. Cl.[7] ..... E05D 15/16
(52) U.S. Cl. ..... 16/105; 16/99; 49/420
(58) Field of Search ..... 16/105, 99, 100; 49/420, 421, 425

(56) References Cited

U.S. PATENT DOCUMENTS

| | | | | |
|---|---|---|---|---|
| 3,040,391 | | 6/1962 | Saunders . | |
| 3,283,444 | | 11/1966 | Andres . | |
| 3,526,995 | | 9/1970 | Saunders . | |
| 3,619,947 | * | 11/1971 | Burum | 16/105 |
| 4,030,160 | * | 6/1977 | Lambertz et al. | 16/105 |
| 4,102,009 | * | 7/1978 | Kelly | 16/105 |
| 4,104,829 | * | 8/1978 | Agcaoili | 16/105 |
| 4,189,870 | * | 2/1980 | Helmick | 16/105 |
| 4,262,451 | * | 4/1981 | Dallaire | 16/105 |
| 4,805,262 | * | 2/1989 | Marshik | 16/105 |
| 4,850,078 | * | 7/1989 | Libby et al. | 16/105 |
| 5,161,330 | * | 11/1992 | Auriemma | 16/105 |
| 5,845,363 | * | 12/1998 | Brempell et al. | 16/105 |

FOREIGN PATENT DOCUMENTS

| | | |
|---|---|---|
| 24 55 399 A1 | 5/1975 | (DE) . |
| 24 10 870 C3 | 8/1982 | (DE) . |
| 33 38 146 A1 | 7/1984 | (DE) . |
| 33 08 812 A1 | 9/1984 | (DE) . |
| 197 09 808 A1 | 9/1998 | (DE) . |
| 0 679 787 A1 | 11/1995 | (EP) . |
| 2751367-A1 * | 1/1998 | (FR) . |

* cited by examiner

*Primary Examiner*—Chuck Y. Mah
(74) *Attorney, Agent, or Firm*—Akin, Gump, Strauss, Hauer & Feld, L.L.P.

(57) ABSTRACT

A running carriage (1) includes a support piece (27) connected to the roller carrier (25) in an articulated manner. The support piece (27) is preferably injection molded as a single piece. Using an adjusting and displacing bolt (41) screwed into the support piece (27), the mutual angular position of the support piece (27) and the roller carrier (25) can be adjusted and displaced.

10 Claims, 1 Drawing Sheet

RUNNING CARRIAGE FOR A SLIDING DOOR

BACKGROUND OF THE INVENTION

The present invention relates to a running carriage for a sliding door, including a pair of carrying rollers arranged on a shaft or a pair of sliding shoes intended for engagement in a running rail arranged above the sliding door and having internal running surfaces, a roller carrier by which the shaft or the pair of sliding shoes is carried, a support piece for connecting the running carriage with the sliding door, and a device for adjusting the height of the sliding door relative to the running rail. The roller carrier and the support piece are connected together by a joint, and their mutual angular position can be adjusted and displaced by an adjusting and displacing screw.

Running carriages for sliding doors are known in many different designs. They function for the purpose of hanging the sliding door on a running rail and making it laterally slideable with as little resistance as possible. The running carriages can be provided with rollers which roll along in a running rail on a cabinet, on a ceiling or as grating in a window opening, or they can be provided with sliding shoes, which slide in the running rail. Modem running carriages must be able to be attached to the sliding door and introduced into the running rail with a small time expenditure. In addition, height adjustability should be available, in order to compensate for dimensional tolerances on the sliding door and/or on the cabinet.

From U.S. Pat. No. 3,619,947 a single-piece running carriage for a grating is known, which can be installed in the corner region of the frame of the grating. The running carriage carries the weight of the grating or a sliding door on a rail lying below. For assembly of the sliding door, measures must be taken which allow the sliding door to be lifted up within the door opening, in order to be able to introduce the rollers on the lower part of the frame into the corresponding rails.

When a sliding door made in this way is improperly operated, the door can jump out of the rail by the momentum which occurs at the end during impact. An assembly of the known running carriage in a closed rail is not possible, i.e. in a rail that receives the rollers of the running carriage internally and thus prevents the rollers from jumping out of the rails.

A similar embodiment is disclosed with the running carriage in U.S. Pat. No. 3,526,995, in which the running roller can be pivoted in for inserting the sliding door into the rails lying below the sliding door. Here also, there is always the danger that the door jumps out of the rail when improperly handled. Introducing the known running carriage into a closed rail system is not possible.

BRIEF SUMMARY OF THE INVENTION

An object of the present invention is to create a running carriage of the above-described type, which allows the sliding door to be guided on a closed rail arranged above the sliding door.

This object is achieved by a running carriage for a sliding door, which includes a pair of carrying rollers arranged on a shaft or a pair of sliding shoes adapted for engagement in a running rail arranged above the sliding door and having internal running surfaces, a roller carrier by which the shaft or the pair of sliding shoes is carried, a support piece for connecting the running carriage with the sliding door, and devices for adjusting the height of the sliding door relative to the running rail, wherein the roller carrier and the support piece are connected together by a joint and their mutual angular position can be adjusted and displaced by an adjusting and displacing screw, wherein the support piece includes a cutout above its base, the cutout having a height which is the same as the thickness of a stay on the horizontal frame piece, and wherein means are constructed on the support piece for tool-free locking of the running carriage on the vertical frame piece.

The running carriage according to the invention has a very simple design. The height adjustment can be done at any time after installation. In other words, it can even be done after installation of the doors in the cabinet or a wall opening whose height can be adjusted relative to the running rail. The running carriage—in contrast to the two known running carriages of the prior art—is first of all introduced into the running rail and held there on all sides. The connection to the sliding door occurs only after the latter has been inserted into the provided opening, in which the running carriage or the two running carriages, which are necessary for a sliding door, are pushed into the end face of the frame of the sliding door. Even improper operation of the sliding door or an object disposed within the driving region of the sliding door, which exerts a force on the sliding door, cannot lift the latter out of the rail, since the rollers of the running carriage are guided within the closed rail and cannot lift out of it. The rollers and the rail cannot be contaminated.

BRIEF DESCRIPTION OF SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings.

DETAILED DESCRIPTION OF THE INVENTION

Figure 2:
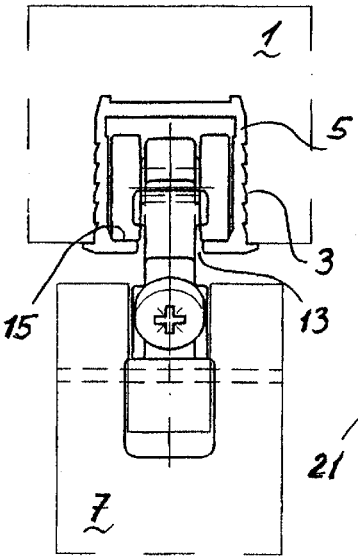
FIG. 2 is a longitudinal side view of the running carriage.
Figure 1:
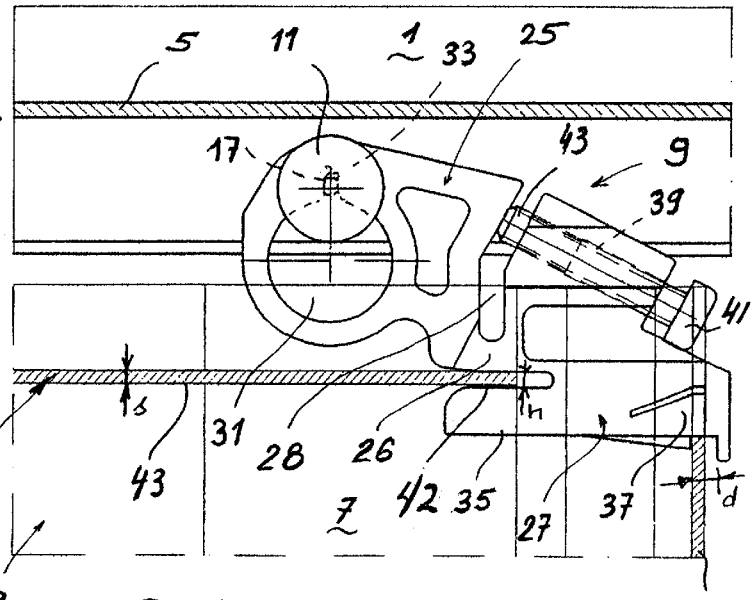
FIG. 1 is an end view of a running carriage according to a first embodiment of the invention installed in a cabinet (the cabinet and sliding door being depicted in dashed lines)
Figure 3:
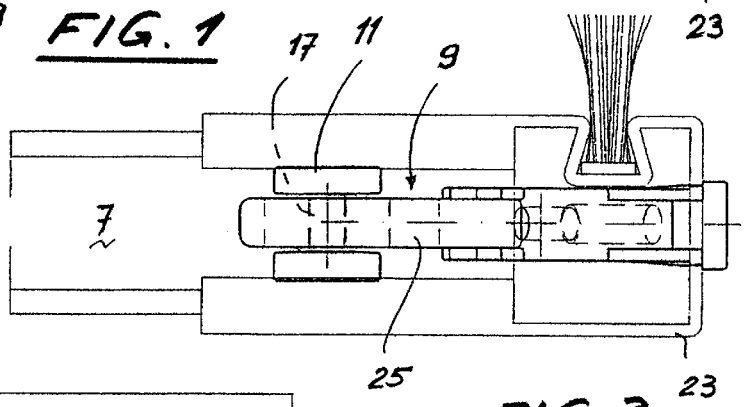
FIG. 3 is plan view of the running carriage.
Figure 4:
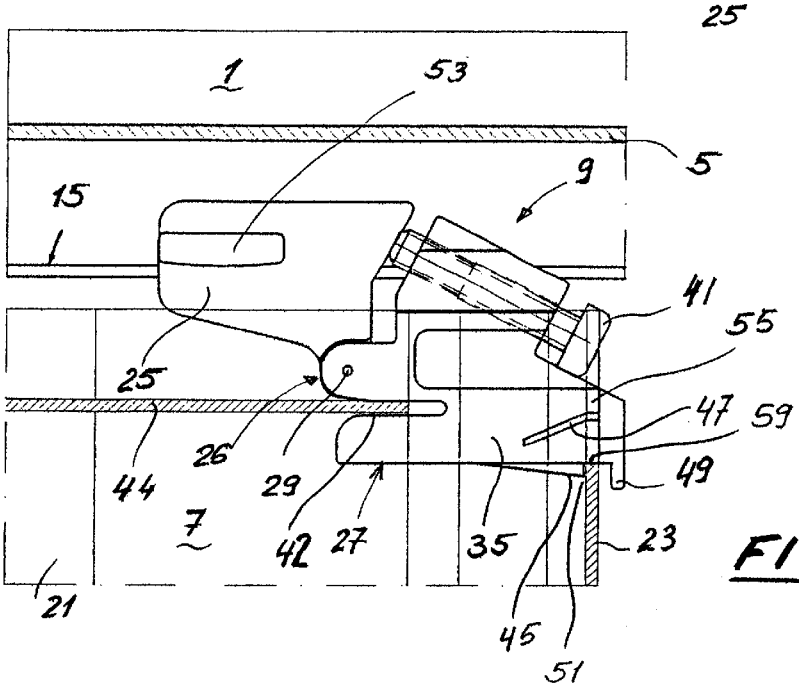
FIG. 4 is a longitudinal side view of a second embodiment of the running carriage having a joint formed by a bolt and a sliding shoe instead of a roller.

As shown in FIGS. 1–3, the ceiling of a room, cabinet, or an upper border of window opening is indicated with reference numeral 1, in which a running rail 5 having internal running surfaces 15 is installed in a groove 3. Reference numeral 7 indicates a sliding door, which is connected by a running carriage 9 to the running rail 5 or ceiling 1. The running rail 5 has a C-shaped design and is constructed for receiving a roller pair 11, which rolls along on the running surfaces 15 arranged laterally to a slit 13 lying below in the running rail 5. The roller pair 11 is connected together by a shaft 17 and sits on the two ends of the shaft. In the embodiment shown, the sliding door 7 is enclosed by a profile frame 19, of which only the upper horizontally lying frame piece 21 and an end face frame piece 23 are visible in FIGS. 1, 2 and 4. Together the two connected frame pieces 21 and 23 form one of the two upper comers of the sliding door 7.

The running carriage 9 includes a roller carrier 25 and a support piece 27. These two parts are pivotably connected to each other. In the first embodiment according to FIG. 1, the roller carrier 25 and the support piece 27 are manufactured as a single piece of plastic and connected together in an articulated or elastic manner by a stay or a joint or thinned portion 26—generated by a cutout that divides the running carriage 1 into the roller carrier 25 and the support piece 27. Alternatively, the joint portion 26 can result from a hinge-type connection of the roller carrier 25 to the support piece 27 (see FIG. 4). A bolt 29 holds the two parts together. The bolt 29 can be a separately manufactured part or it can be injected molded onto one of the parts to be connected and engage into a corresponding complementary bore hole in the other part. A preferably circular-shaped opening 31 is provided in the roller carrier 25, having a diameter that is larger than the diameter of the rollers 11. This opening or cutout 31 makes it possible to introduce the roller pair 11 connected by the shaft 17 axially into the roller carrier 25 and to arrest it in a radially outward running slot 33. The assembly of the roller pair 11 into the roller carrier 25 is, as a result, tool-free.

The support piece 27 includes a base 35, which can be shoved into a correspondingly constructed cutout in the sliding door 7 or the frame piece 23 and can be caught by elastic catch mechanisms 37 in the inserted position. The upper part of the support piece 27 is penetrated by a bore hole 39, into which an adjusting and displacing bolt 41 is screwed. If the adjusting and displacing bolt 41 has a self-tapping thread, the bore hole 39 can be made without threads. The front end 43 of the adjusting and displacing bolt 41 projects beyond the bore hole 39 and rests against the end face of the roller carrier 25 in the cutout 28.

The lower section of the support piece 27 includes above the base 35 a cutout 42, having a height "h" equal to or slightly smaller than the thickness "s" of the stay 44 on the frame piece 21. On the lower edge of the base 35, a wedge-shaped shoulder 45 is additionally constructed, and above it a rib 47 is made on both sides and guides the running carriage 9 laterally in the frame 19 (see FIG. 4). The wedge-shaped shoulder 45 ends at a distance from the rear end of the support piece 27 as a catch edge 51. The rear-side end of the base 35 is limited by a downwardly-projecting nose 49. This nose lies at a distance "d" from the catch edge 51, which distance is larger than the thickness of the plate which forms the frame piece 23.

As an alternative to the roller pair 11, sliding shoes 53 can be molded onto or inserted laterally on the roller carrier 25 (FIG. 4) and slide on the two running surfaces 15.

Of course, in a running carriage 9 having sliding shoes 53, an elastic joint connection 26 as depicted in FIG. 1 can also be provided, and also in an embodiment with a bolt 29 as the joint 26, a running roller 11 can replace a sliding shoe 53. As a result, all combinations of joint portions and running rollers 11 or sliding shoes 53 are possible.

The assembly of the running roller pair 11 and the adjusting and displacing bolt 41 on the roller carrier 25 or on the support piece 27 can be done manually or with a simple mounting device in a cost-effective manner. The installation of the running carriage 9 in a sliding door 7 is also possible without tools, by corresponding preparation of a punched-out receiving cutout 55 for the support piece 27 on the end face in the frame piece 23. The running carriage 9 is introduced in the end face through the receiving cutout 55 in the frame piece 23 and is guided so that it is held fixed with the cutout 42 on the front end of the stay 44. As soon as the base 35 is completely introduced, the wedge 45 also catches on the frame piece 23 and is held immovably fixed by it. In addition, the weight of the sliding door 7 exerts a force on the running carriage 9, which presses the support piece 27 onto the lower edge 59 of the receiving cutout 55 in the frame piece 23. The adjustment of the sliding door 7 relative to the running rail 5 and the underside of the ceiling 1 can be done at any time with the help of a screwdriver, on the end face of the sliding door.

It will be appreciated by those skilled in the art that changes could be made to the embodiment(s) described above without departing from the broad inventive concept thereof It is understood, therefore, that this invention is not limited to the particular embodiment(s) disclosed, but it is intended to cover modifications within the spirit and scope of the present invention as defined by the appended claims.

I claim:

1. A running carriage (1) for a sliding door (7), comprising a pair of carrying rollers (11) arranged on a shaft (17) or a pair of sliding shoes (53) adapted for engaging a running rail (5) arranged above the sliding door (7) and having internal running surfaces (15), a roller carrier (25) by which the shaft (17) or the pair of sliding shoes (53) is carried, a support piece (27) for connecting the running carriage (1) with the sliding door (7), the roller carrier (25) and the support piece (27) being connected together by a joint (26) such that a mutual angular position between the roller carrier (25) and the support piece (27) is adjustable by an adjusting bolt (41) carried in the support piece for adjusting the height of the sliding door (7) relative to the running rail (5), the support piece (27) including a base (35) and a cutout (42) above the base (35), the cutout (42) having a height (h) approximately equal to a thickness (s) of a stay (44) on a horizontal frame piece (21) of the sliding door (7), and a catch element (45) constructed on the support piece (27) for tool-free catching of the running carriage (1) on a vertical frame piece (23) of the sliding door (7).

2. The running carriage according to claim 1, wherein guides (47) are constructed on the support piece (27) for laterally guiding the running carriage (9) in a frame (19) of the sliding door (7).

3. The running carriage according to claim 2, wherein the catch element (45) comprises a wedge-shaped shoulder having a catch edge (51) offset from a rear end of the support piece (27).

4. The running carriage according to claim 3, wherein a downwardly-projecting nose (49) is constructed on the support piece (27), the nose (49) lying at a distance (d) from the catch edge (51), and the distance (d) is larger than a thickness of a plate which forms the frame piece (23) and on which the catch edge (51) catches.

5. The running carriage according to claim 1, wherein the joint (26) is constructed as an elastically flexible stay or as a thinned portion between the roller carrier (25) and the support piece (27).

6. The running carriage according to claim 1, wherein the roller carrier (25) and the support piece (27) are formed as a single piece and the joint (26) is formed by a thinned portion (26) lying at a base of a cutout (28) in the single piece.

7. The running carriage according to claim 1, wherein the joint (26) is formed by a bolt (29) connecting the roller carrier (25) to the support pace (27).

8. The running carriage according to claim 1, wherein the roller carrier (25) has a central cutout (31), through which one of the pair of rollers (11) connected to the shaft (17) can be introduced, and the shaft can be inserted and can catch in a slot (33) running radially outwardly from an inner edge of the cutout (31).

9. The running carriage according to claim 1, wherein the adjusting bolt (41) is guided lengthwise in a bore hole (39) in the support piece (27).

10. The running carriage according to claim 1, further comprising an elastic catch mechanism (37) constructed on the support piece (27) for attachment of the support piece (27) to the sliding door (7).

* * * * *